US011670470B2

(12) United States Patent
Thizon et al.

(10) Patent No.: US 11,670,470 B2
(45) Date of Patent: Jun. 6, 2023

(54) STACKABLE BLOCK WITH REDUCED HEIGHT FOR A CONTROL UNIT

(71) Applicant: Schneider Electric Industries SAS, Rueil Malmaison (FR)

(72) Inventors: Patrice Thizon, Ruelle-sur-Touvre (FR); Thierry Fort, Gimeux (FR); Gregory Bouchery, Soyaux (FR)

(73) Assignee: Schneider Electric Industries SAS, Rueil Mailmaison (FR)

( * ) Notice: Subject to any disclaimer, the term of this patent is extended or adjusted under 35 U.S.C. 154(b) by 0 days.

(21) Appl. No.: 17/479,224

(22) Filed: Sep. 20, 2021

(65) Prior Publication Data

US 2022/0102094 A1 Mar. 31, 2022

(30) Foreign Application Priority Data

Sep. 25, 2020 (FR) ..... 2009766

(51) Int. Cl.
*H01H 33/42* (2006.01)
*H01H 33/53* (2006.01)
*H01H 33/60* (2006.01)

(52) U.S. Cl.
CPC ..... *H01H 33/42* (2013.01); *H01H 33/53* (2013.01); *H01H 33/60* (2013.01)

(58) Field of Classification Search
CPC ..... H01H 33/42; H01H 33/53; H01H 33/60; H01H 13/503; H01H 13/14; H01H 13/12; H01H 13/20; H01H 13/02; H01H 13/10; H01H 13/52; H01H 13/023; H01H 13/00; H01R 9/2433
USPC ..... 218/146, 16 A, 30, 31, 140; 200/242, 200/243
See application file for complete search history.

(56) References Cited

U.S. PATENT DOCUMENTS 4,121,076 A * 10/1978 Taylor ..... H01H 11/0012 200/280
4,157,463 A 6/1979 Fujita
(Continued)

FOREIGN PATENT DOCUMENTS

DE 2064706 A1 8/1972
DE 19856678 A1 4/2001

OTHER PUBLICATIONS

French Search Report and Written Opinion dated Jun. 15, 2021 for French Patent Application No. FR2009766, 9 pages.

*Primary Examiner* — William A Bolton
(74) *Attorney, Agent, or Firm* — Locke Lord LLP

(57) ABSTRACT

Stackable electric contact block including a casing that defines its volume, the casing having upper and lower faces for connecting the block to another component, the casing accommodating a screw for fixing the block to another component, and a press rod capable of moving from a rest position to an activation position for transferring a translation force to a component attached to the lower face of the casing, the press rod including an activation head in the form of a wedge capable of engaging with a push-button or a rotary knob, the casing including a cavity for guiding the press rod between its rest and activation positions, in which cavity the press rod is accommodated. A device for guiding the press rod into the guide cavity includes a guide tab accommodated in a matching guide slot passing through the activation head.

12 Claims, 17 Drawing Sheets

(56) References Cited

U.S. PATENT DOCUMENTS

| | | | | |
|---|---|---|---|---|
| 4,262,179 | A * | 4/1981 | Bauer | H01H 1/20 200/243 |
| 4,443,675 | A * | 4/1984 | Drexler | H01H 50/546 200/243 |
| 6,198,058 | B1 * | 3/2001 | Graninger | H01H 13/503 200/16 R |
| 6,657,148 | B2 * | 12/2003 | Thizon | H01H 11/0012 200/16 A |
| 6,667,448 | B2 * | 12/2003 | Schaefer | H01H 11/0012 200/243 |
| 8,159,321 | B2 * | 4/2012 | Bollinger | H01H 50/546 335/106 |
| 9,613,761 | B2 | 4/2017 | Bruchschmidt et al. | |
| 2003/0000814 | A1 * | 1/2003 | McGill | H01H 50/546 200/16 R |
| 2013/0192968 | A1 * | 8/2013 | Schlegel | H01H 1/2025 200/502 |
| 2015/0287551 | A1 * | 10/2015 | Uitto | H01H 1/2041 200/243 |

* cited by examiner

STACKABLE BLOCK WITH REDUCED HEIGHT FOR A CONTROL UNIT

TECHNICAL FIELD

The present disclosure relates to a stackable electric contact or signalling block comprising a casing that defines its volume, the casing having upper and lower faces for connecting the block to another component, the casing accommodating the following elements:

a screw for fixing the block to another component; and a press rod capable of moving from a rest position to an activation position for transferring a translation force to a component attached to the lower face of the casing, the press rod comprising an activation head in the form of a wedge capable of translationally engaging with a push-button or of rotationally engaging with a rotary knob;

the casing comprising a cavity for guiding the press rod between its rest and activation positions, in which cavity the press rod is accommodated.

PRIOR ART

Such electric contact blocks are known. One example is the electric contact block sold by the applicant under reference ZB2BE. FIGS. 1 to 3 illustrate this known electric contact block. FIG. 1 is a perspective overview of the contact block, FIG. 2 is a section view along the arrows II-II of FIG. 1, and FIG. 3 is an exploded view.

This electric contact block 100 is used as a component of a control and signalling unit. It allows an electric contact to be established or broken. It is conventionally applicable, for example, in an emergency stop button. Such buttons are particularly used to rapidly cut-off the power supply of installations or of machines in the event of an accident or of damage.

The contact block 100 shown in FIGS. 1 to 3 is of the "normally open" type (NO type). It comprises two electric terminals 101 and 103 that are integrated in a casing 102. The casing 102 is provided with a fixing screw or an extendable screw 104. By virtue of the fixing screw 104, the contact block 100 can be fixed to other components, such as a button body, for example.

A press rod 106 is slidably arranged in the casing 102. The press rod 106 comprises an activation head 108. Pressing the activation head 108, presses the press rod 106 into the casing 102. Thus, an electric contact is established between the two electric terminals 101 and 103.

This known contact block 100 has certain advantages. It is stackable and compatible with push-buttons and with rotary knobs. Furthermore, by virtue of the extendable screw, it has a very reliable fixing means. Furthermore, its electrical insulation distances are sufficient for applications with a standard power supply voltage of 230 V.

However, this known contact block has the disadvantage of requiring considerable height. Indeed, the press rod 106 must have a pronounced height, i.e. a sleek form, in order to allow it to properly slide in the guide cavity. If the press rod is not high enough, then it risks becoming wedged in the cavity, which would lead to a failure of the contact block 100. In order for it to remain operational, the known contact block 100 therefore must have a minimum height. Due to this minimum height, it is often impossible for more than two contact blocks 100 to be stacked in the same control unit.

The same problem is encountered for the signalling blocks that are also used as components of control and signalling units. Indeed, a stack of one signalling block and of two or more contact blocks 100 often cannot be contemplated due to the excessive height of the resulting stack.

All of the above is inconsistent with the current trend on the market for miniaturisation.

SUMMARY

Therefore, an aim of the present disclosure is to propose a stackable electric contact or signalling block, which, by virtue of its construction, does not have such a limitation with respect to its height and as far as possible keeps the advantages of the aforementioned known blocks.

According to the present disclosure, this aim is achieved by providing the electric contact or signalling block defined in § [0001] with a device for guiding the press rod into the guide cavity comprising a guide tab accommodated in a matching guide slot passing through the activation head.

This guide device in the form of a matching tab and slot assembly, with the slot passing through the activation head, provides precise and reliable guidance for the press rod, in particular when the height of said press rod is low. Thus, there is no longer any risk of the press rod becoming wedged, which allows the contact or signalling block to be made considerably smaller.

The features disclosed in the following paragraphs optionally can be implemented. They can be implemented independently of one another or in combination with one another:

The press rod comprises a base supporting the activation head, and wherein the guide slot also passes through the base;

The guide device comprises two guide tabs, each of which is accommodated in a matching guide slot passing through the activation head;

Each guide tab forms part of the casing;

The press rod has a substantially H-shaped transverse section;

The press rod has an external face, an internal face and two lateral faces, and each guide slot is produced in one of the lateral faces;

The casing also accommodates at least one return spring for the press rod, with the return spring being located next to one of the lateral faces of the press rod;

The casing accommodates two separate return springs for the press rod, with one of the two return springs being located next to one of the two lateral faces of the press rod and the other one of the return springs being located next to the other one of the two lateral faces of the press rod;

The block is an electric contact block, and the press rod supports a movable electric contact bridge that moves together with the press rod;

The movable bridge is substantially U-shaped;

The travel of the movable bridge is guided by guide walls of the casing;

The casing also accommodates two electric terminals, with the movable bridge being adapted, by the movement thereof, to break or establish an electric contact between the two electric terminals, the two electric terminals and the movable bridge are located together in an arc extinguishing chamber, and the arc extinguishing chamber is surrounded by an electrical insulation chamber that forms part of the casing.

The present disclosure also relates to a stackable electric contact block comprising a casing that defines its volume, the casing having upper and lower faces for connecting the block to another component, the casing accommodating the following elements:

a screw for fixing the block to another component; and a press rod capable of moving from a rest position to an activation position for transferring a translation force to a component attached to the lower face of the casing, the press rod supporting a movable electric contact bridge that moves together with the press rod, the movable bridge having a substantially U-shape.

Preferably, the travel of the U-shaped movable bridge is guided by guide walls of the casing.

BRIEF DESCRIPTION OF THE DRAWINGS

Further features, details and advantages will become apparent from reading the following detailed description, and from analysing the accompanying drawings, in which.

DESCRIPTION OF THE EMBODIMENTS

In the first instance, reference is made to FIGS. 4 to 9. These figures show an embodiment 100 of a stackable electric contact block according to the present disclosure.

The purpose of the electric contact block 100 is to be integrated in a control unit. By activating the electric contact block 100 it is possible to establish an electric contact between two electric terminals contained in the contact block. In industrial applications, it is thus possible to provide an electrical installation with an electric current.

Conventionally, there are two types of electric contact blocks, namely normally open (NO) electric contact blocks and normally closed (NC) electric contact blocks.

The electric contact block 100 of FIGS. 4 to 9 is of the normally open type (NO type). Of course, the present disclosure is also applicable to the normally closed type (NC type) of electric contact blocks.

Figure 1:
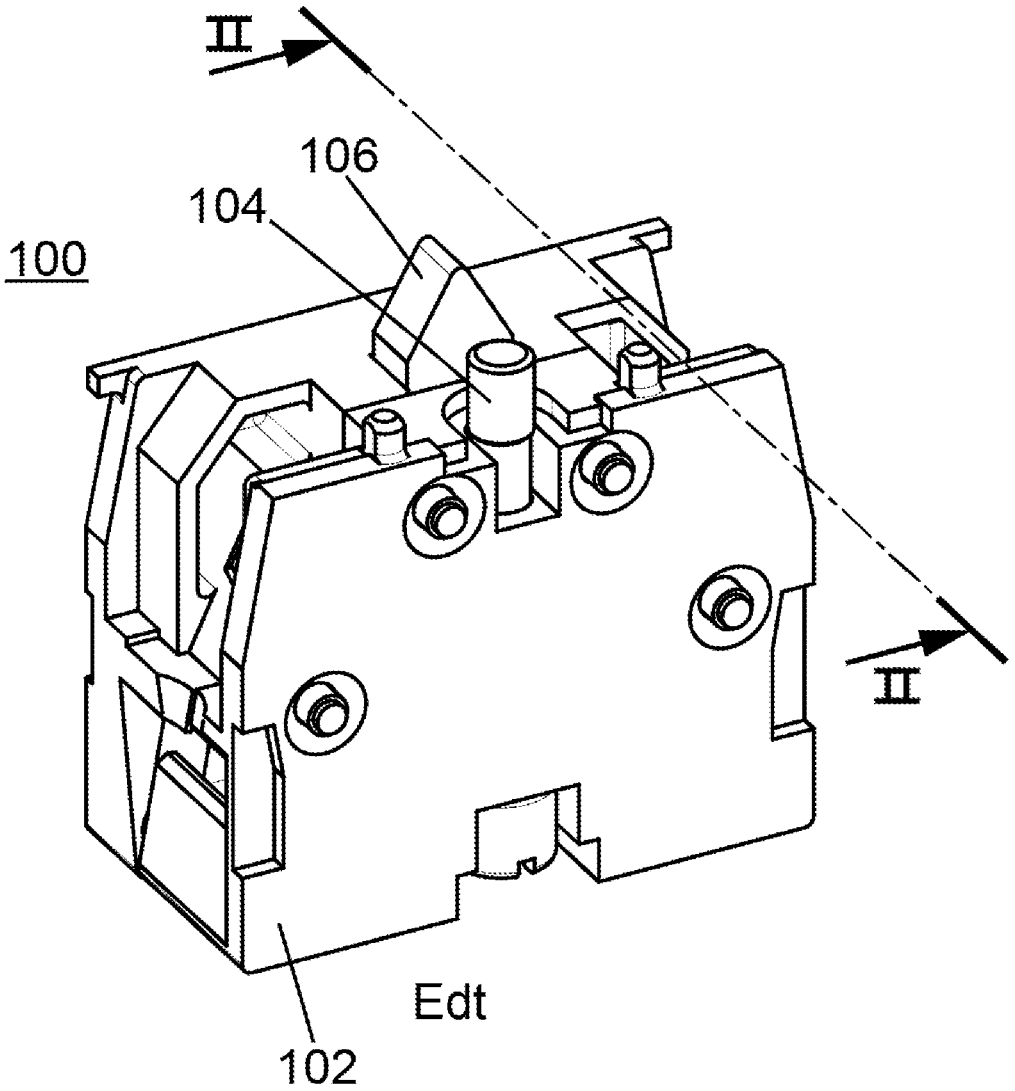
FIG. 1 shows an electric contact block according to the prior art.
Figure 2:
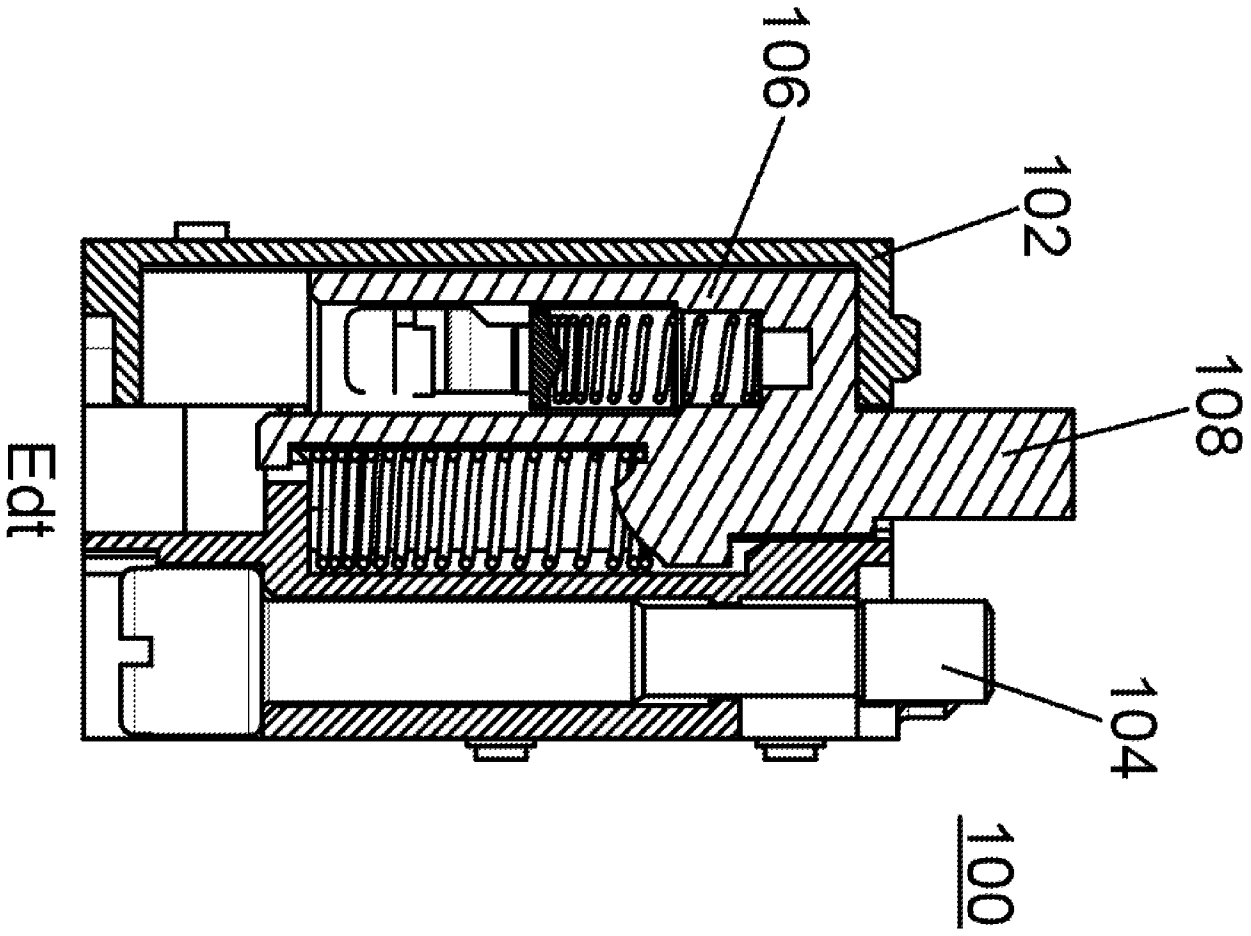
FIG. 2 is a section view of the known contact block of FIG. 1.
Figure 3:
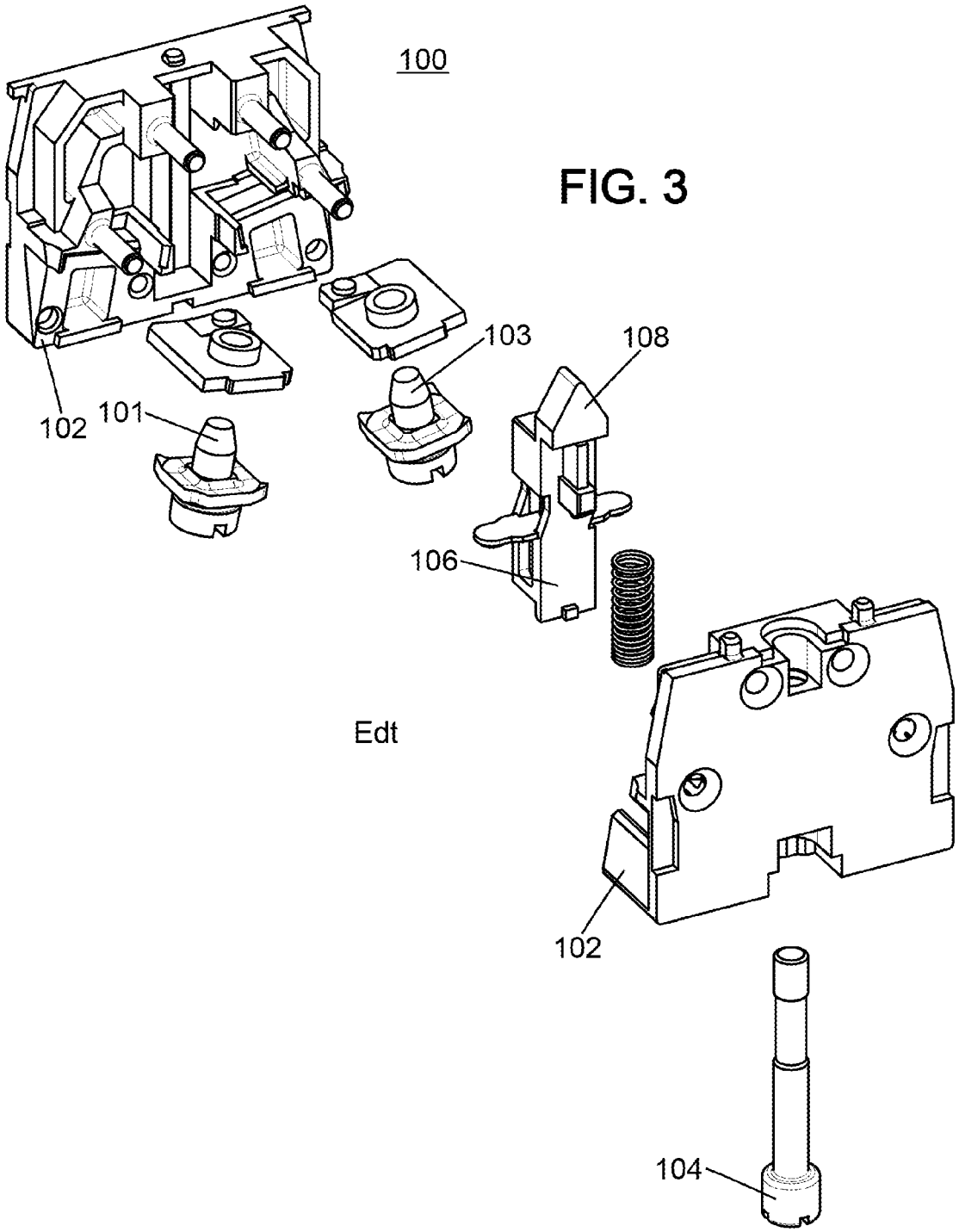
FIG. 3 is an exploded view of the known contact block of FIG. 1.
Figure 4:
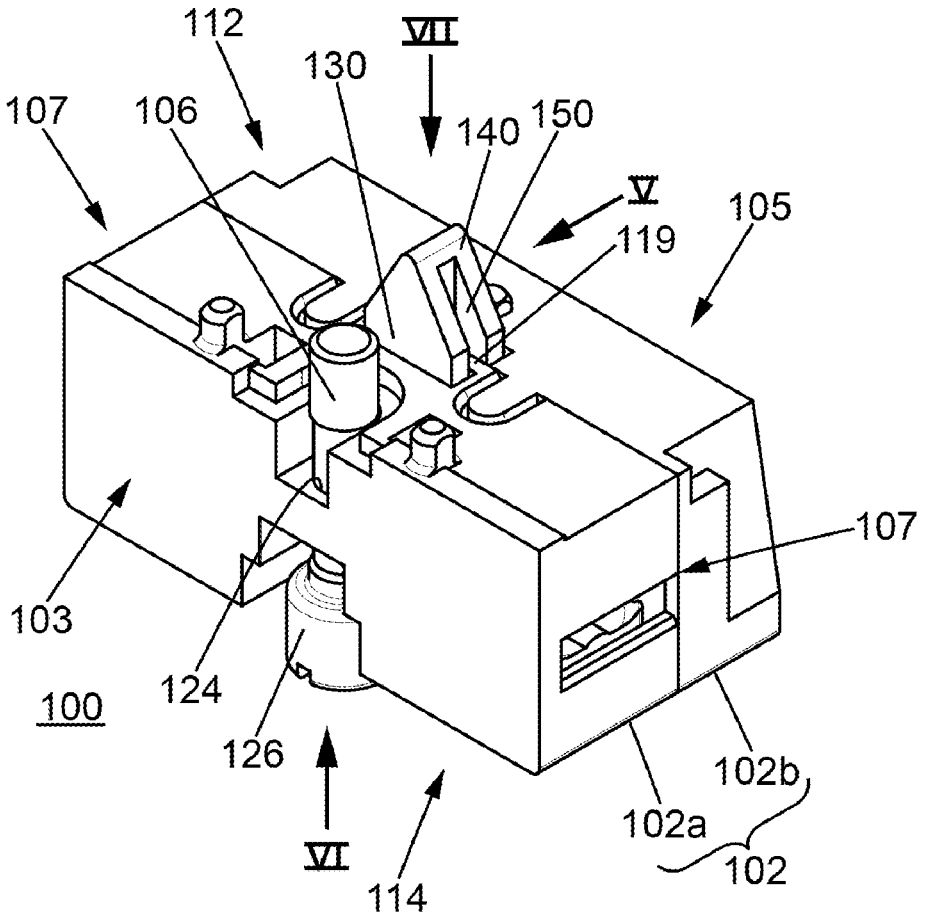
FIG. 4 is a perspective overview of an electric contact block according to one embodiment of the present disclosure.
Figure 5:
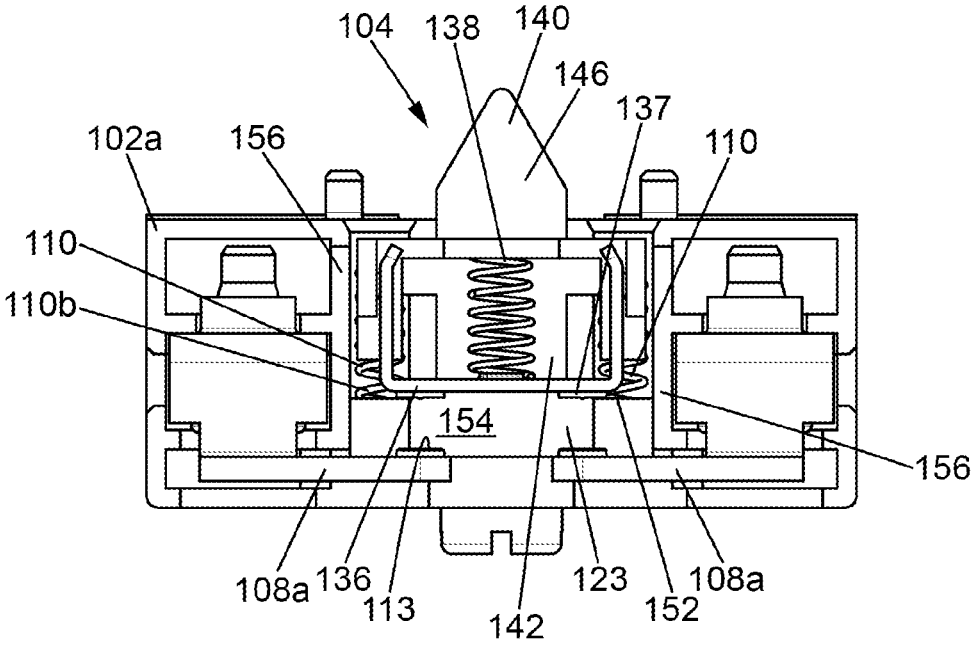
FIG. 5 is a front view along the arrow V of the contact block of FIG. 4, with part of the casing removed.

With reference to FIGS. 4 and 5, the electric contact block 100 comprises a casing 102, a movable contact unit 104, a fixing screw 106, two electric terminals 108, as well as a pair of return springs 110.

The casing 102 is produced in two parts: a first part 102*a* and a second part 102*b*. The two parts 102*a* and 102*b* can be detached, which grants access to the inside of the electric contact block 100. It should be noted that in FIGS. 5 to 8 the second part 102*b* of the casing 102 is missing. Therefore, in these figures only the first part 102*a* of the casing 102 can be seen. The first part 102*a* of the casing 102 accommodates the fixing screw 106.

The casing 102 defines the volume of the electric contact block 100. It has a substantially parallelepiped shape. It has upper 112 and lower 114 faces for connecting the electric contact block 100 to another component. It also has an external face 103, an internal face 105 and two lateral faces 107.

Figure 10:
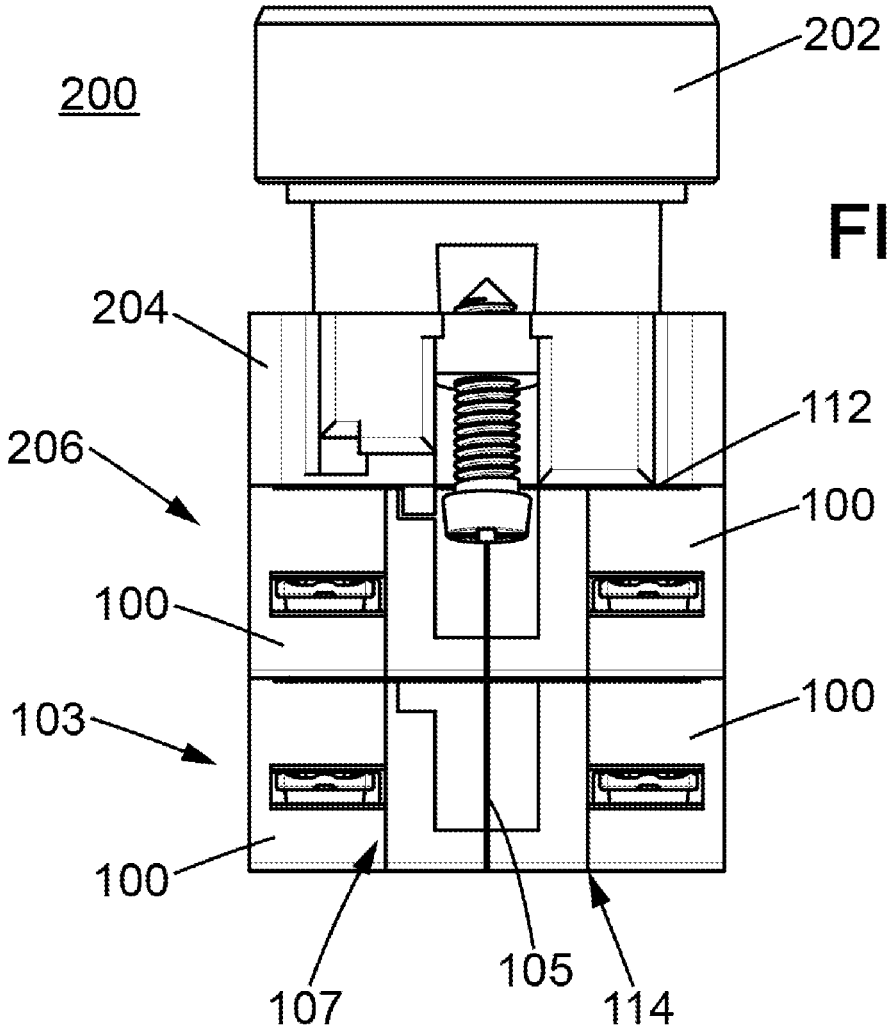
FIG. 10 is a side view of a button control unit comprising four stacked contact blocks according to FIG. 4.
Figure 11:
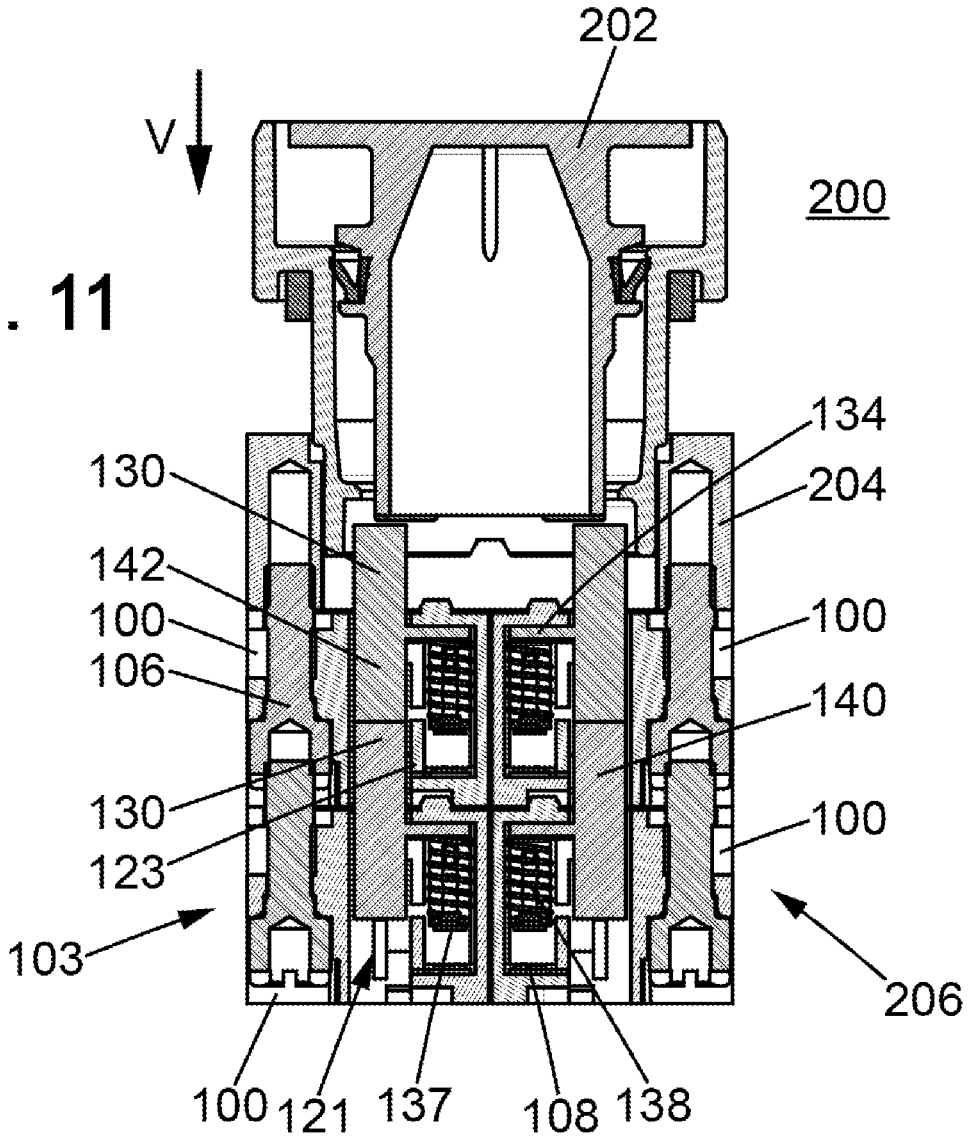
FIG. 11 is a section view of the control unit of FIG. 10.
Figure 12:
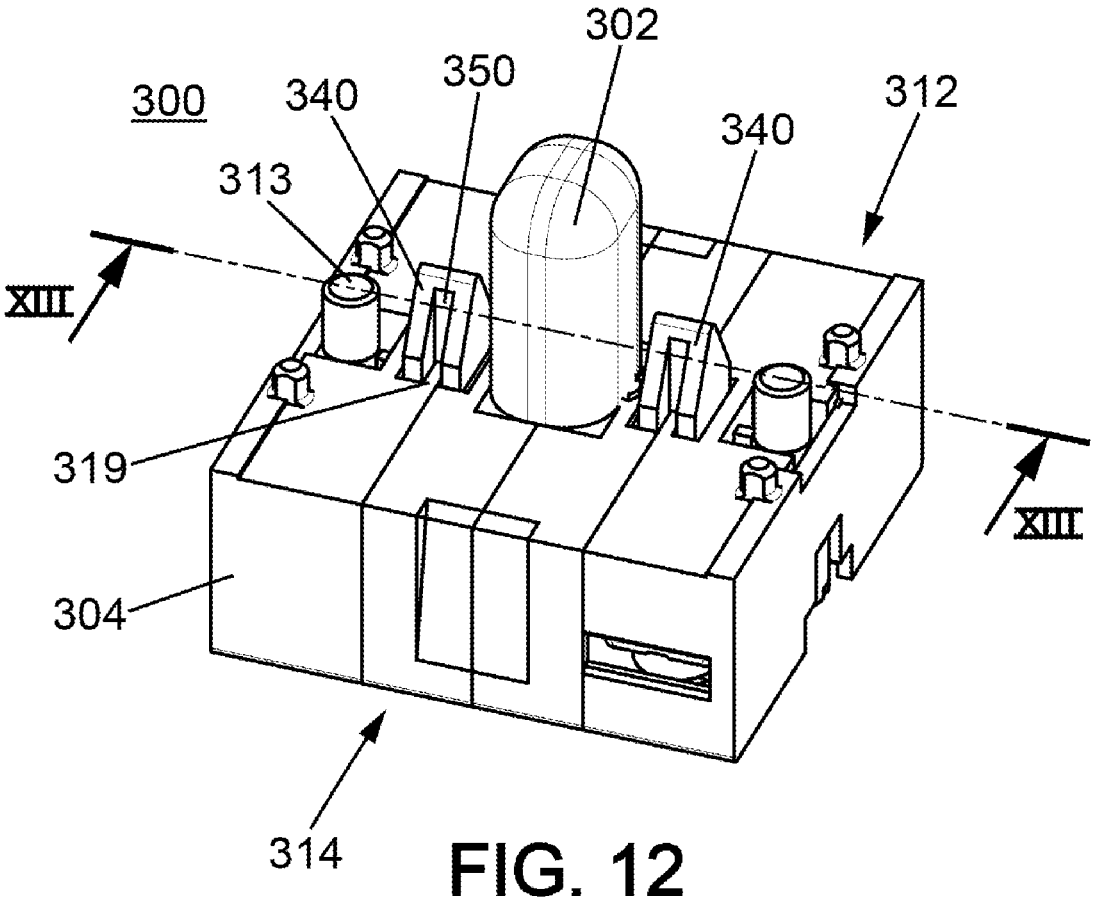
FIG. 12 is a perspective overview of a signalling block according to one embodiment of the present disclosure.
Figure 13:
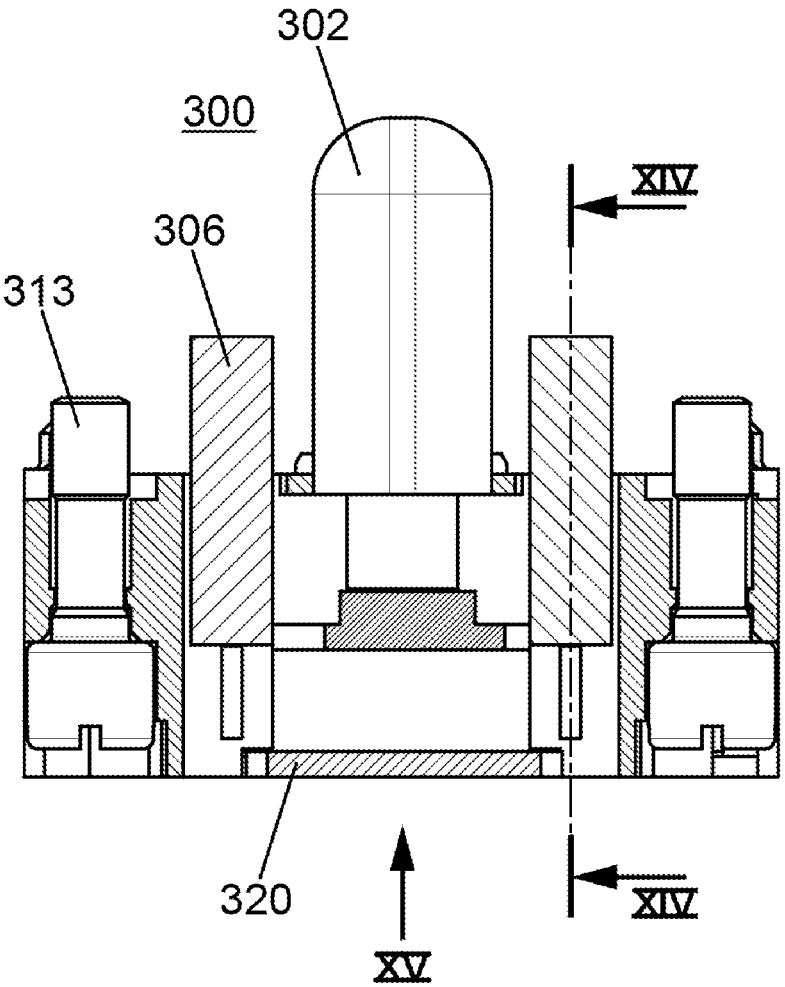
FIG. 13 is a longitudinal section view along the arrows XIII of the signalling block of FIG. 12.

The external face 103 of the casing 102 is defined as the face located outside the stack when the electric contact block 100 is stacked (see FIGS. 10 and 11). The internal face 105 of the casing 102 is the face that is located at the centre of the stack. The upper face 112 of the casing 102 is the face by which the electric contact block 100 is fixed to the remainder of the stack during the assembly thereof. The lower face 114 allows another component to be connected to the already stacked electric contact block 100.

Figure 8:
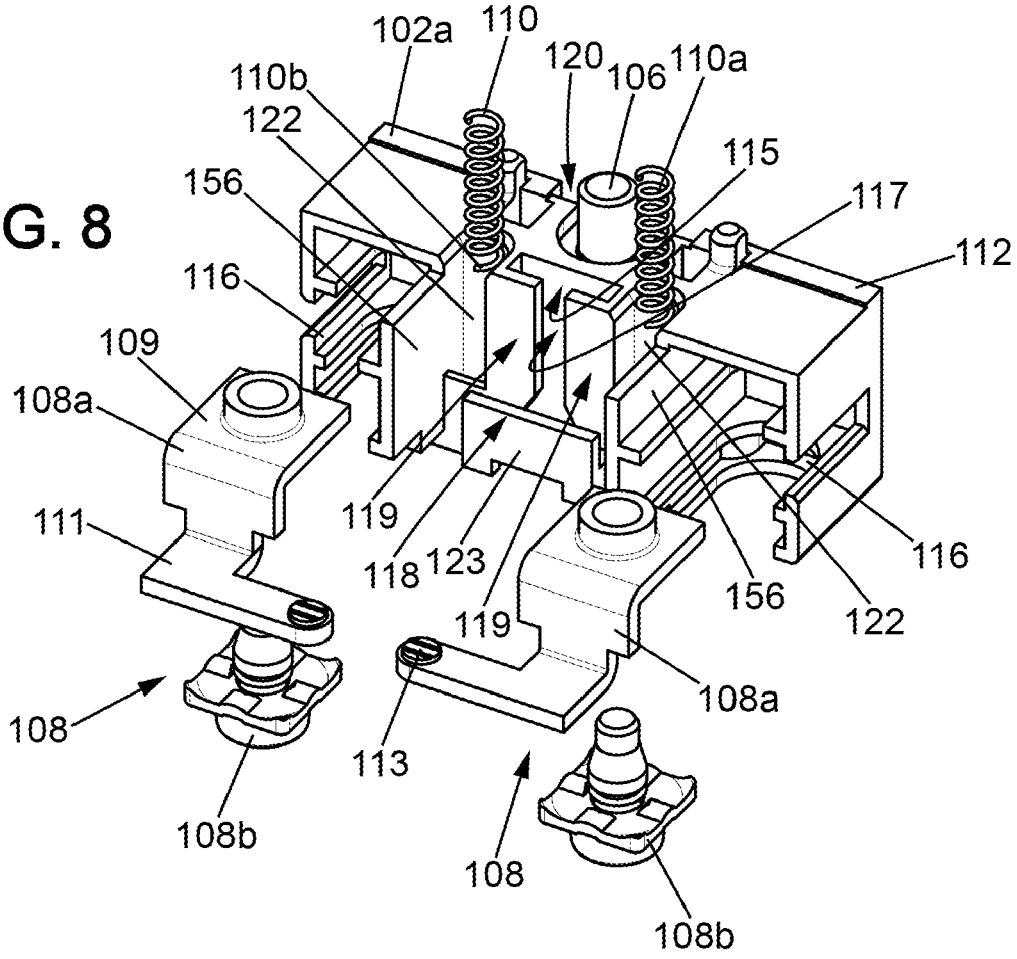
FIG. 8 is an exploded view of the contact block of FIG. 4, with some elements being omitted.
Figure 9:
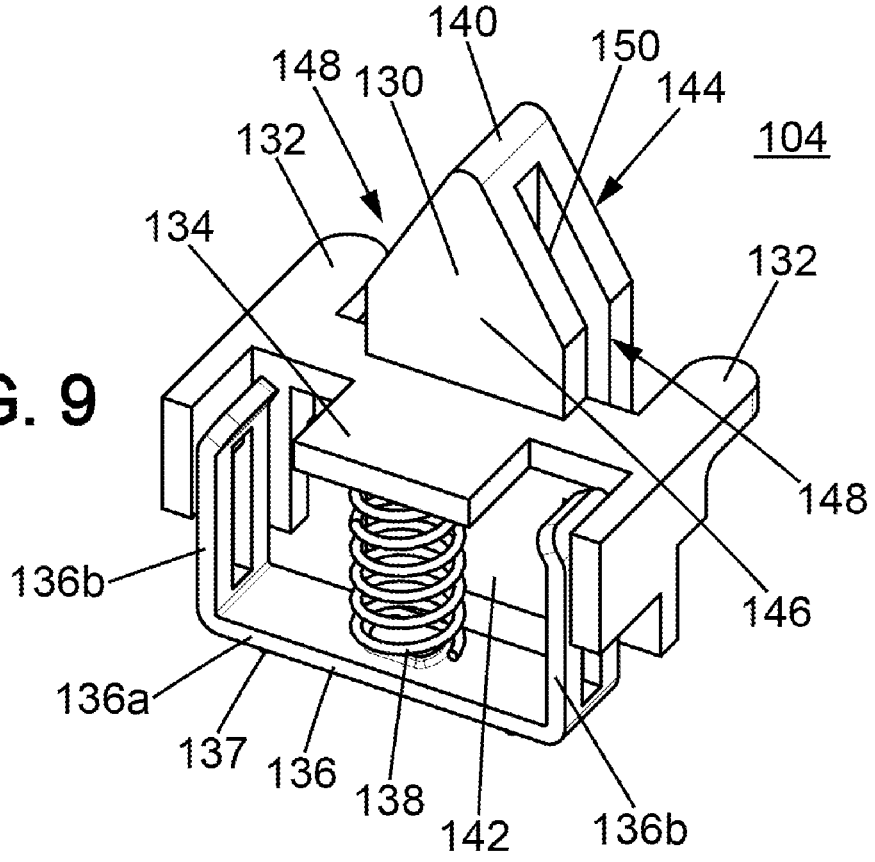
FIG. 9 is a perspective view of a movable contact unit of the contact block of FIG. 4.

The casing 102 has a plurality of zones for accommodating the various elements of the electric contact block 100. FIG. 8 shows a first zone 116 for accommodating electric terminals 108, a second zone 118 for accommodating the movable contact unit 104, a third zone 120 for accommodating the fixing screw 106, and a fourth zone 122 for accommodating return springs 110.

As can be seen in FIG. 4, the fixing screw 106 is accommodated in a through-hole 124 of the casing 102.

Preferably, the fixing screw 106 is an extendable screw. In other words, the head 126 of the screw 106 has a thread 128. By virtue of the thread 128, it is possible to connect another component to the electric contact block 100 by screwing a screw of the other component into the thread 128. In particular, it is thus possible to connect or to stack a plurality of electric contact blocks 100 in this manner. The head 126 of the fixing screw 106 in this case is located on the side of the lower face 114 of the casing 102.

With reference to FIG. 8, the two electric terminals 108 each comprise an electric conductor 108*a* and a clamping screw 108*b*. The electric conductors 108*a* are installed in the casing 102 in the accommodation zone 116. By using the clamping screws 108*b* it is possible to connect an electric wire to each conductor 108*a*. Each conductor 108*a* in this case is produced by a folded metal sheet. Each metal sheet 108*a* has a fixing section 109 that engages with the clamping screw 108*b*, and an electric contact section 111, preferably in the form of a strip. Each strip 111 has an electric contact point 113 at the free end thereof.

The movable contact unit 104 is capable of moving inside the casing 102. It is shown as a perspective view in FIG. 9. This movable contact unit 104 comprises a press rod 130, two spring stops 132, a bridge support 134, a movable electric contact bridge 136 supported by the bridge support 134, and a movable bridge spring 138.

The press rod 130 comprises an activation head 140 in the form of a wedge and a base 142 that supports the activation head 140. The press rod 130 has an external face 144, an internal face 146 and two lateral faces 148.

In a front view, see FIG. 5, the wedge shape of the activation head 140 is in the form of a triangle. In other words, the activation head 140 is in the shape of an arrow tip. This particular shape with two lateral ramps allows the press rod 130 to engage both with a push-button and with a rotary knob. Thus, the electric contact block 100 can be activated either by choosing a push-button or a rotary knob. In the case of applications with a rotary knob, the activation head 140 acts like a cam that allows a rotation movement of the rotary knob to be converted into a translation movement of the movable contact unit 104.

Figure 7:
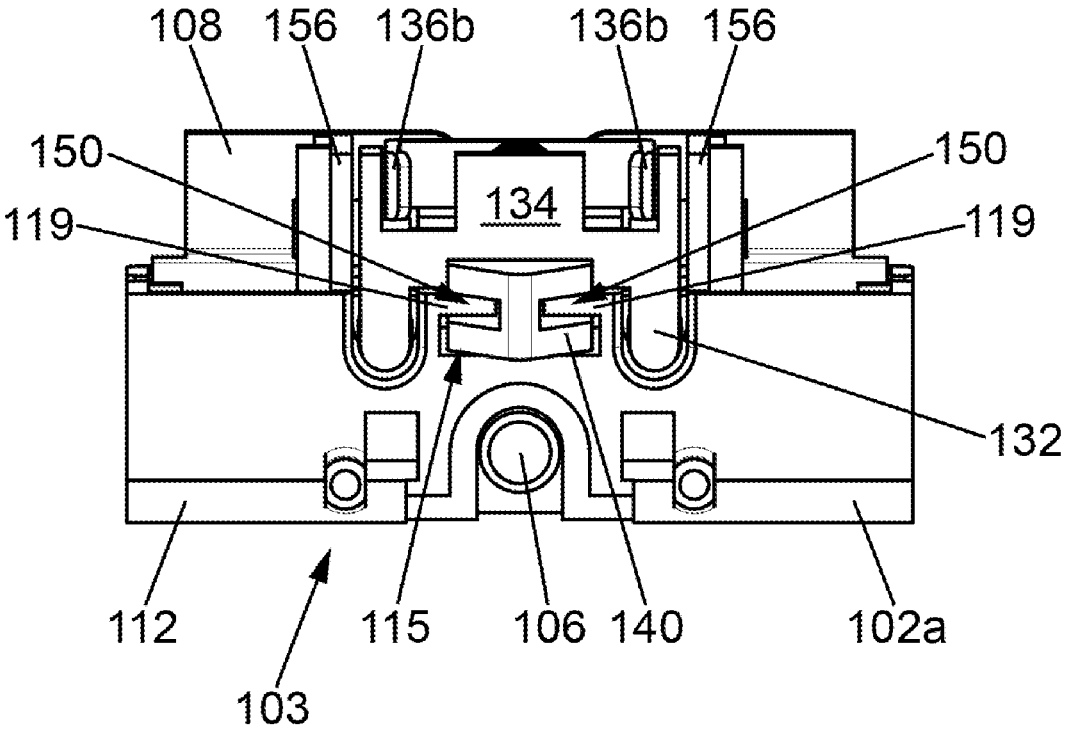
FIG. 7 is a top view along the arrow VII of the contact block of FIG. 4, with part of the casing removed.

It should be noted that the press rod 130 is traversed by two guide slots 150, see FIG. 7. Each guide slot 150 is produced in one of the lateral faces 148 of the press rod 130. The guide slots 150 pass through the activation head 140, and preferably also the base 142.

Figure 6:
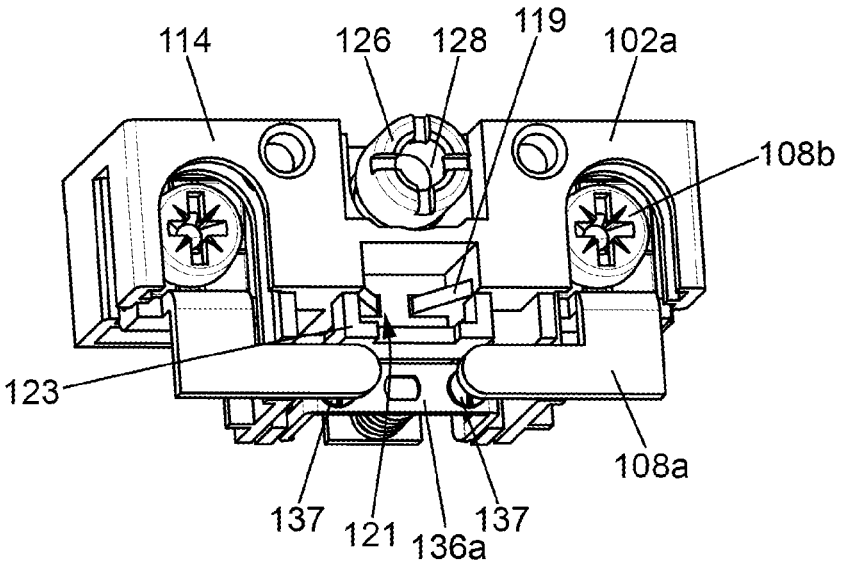
FIG. 6 is a bottom view along the arrow VI of the contact block of FIG. 4, with part of the casing removed.

As can be seen in FIGS. 6 and 7, the press rod 130 has a substantially H-shaped transverse section. In other words, the transverse section of the press rod is made up of two branches that are connected by a cross-member. The gaps between the two branches correspond to the guide slots 150.

It should be noted that, in the illustrated example, the press rod 130, the stops 132 and the bridge support 134 are produced in the form of a single one-piece part.

By means of the support 134, the press rod 130 supports the movable bridge 136. The movable bridge 136 is a separate part of the press rod 130. In this case, it has a substantially U-shape (see FIG. 5). The movable bridge 136 comprises a central contact plate 136*a*, which is extended, at each of the ends thereof, by a branch 136*b* for fixing the movable bridge 136 to the support 134. The bottom of the central plate 136*a* is shown in FIG. 6. Two electric contact points 137 are distinguished in FIG. 6, which points are capable of engaging with the contact points 113 of the electric terminals 108 (see FIG. 5).

Preferably, the movable bridge 136 is metal, since it must conduct an electric current.

The movable bridge spring 138 is a press spring. The press spring 138 forces the movable bridge 136 downwards and thus ensures reliable contact between the movable bridge 136 and the terminals 108 during the activation of the electric contact block 100.

The spring stops 132 are used to support the two returns springs 110. They are located on either side of the press rod 130. In other words, the stops 132 surround the press rod 130. Each stop 132 is produced in the form of a lug that extends from the support 134 towards the external face 103 of the casing 102 (see FIG. 7).

Each return spring 110 is located next to one of the lateral faces 148 of the press rod 130. The upper end 110*a* of each spring 110 comes into abutment on one of the stops 132 of the movable contact unit 104. The lower end 110*b* of each return spring 110 presses on a bottom 152 of the casing 102 (see FIG. 5). Each return spring 110 is accommodated in a corresponding housing 122 of the casing 102.

The first part 102*a* of the casing 102 comprises a cavity 115 for guiding the press rod 130 (see FIGS. 7 and 8). The press rod 130 is movably accommodated in the guide cavity 115. It is capable of translationally moving in the guide cavity 115. The guide cavity 115 has a rectangular transverse section. It connects to the rest of the casing 102 through an oblong opening 117. The oblong opening 117 is in the form of a slot. It is defined by the extent of two guide tabs 119 that partly define the guide cavity 115. The two guide tabs 119 are located opposite each other and are separated by the oblong opening 117.

Each guide tab 119 is accommodated in one of the two guide slots 150 of the press rod 130. The shape of each guide tab 119 matches that of its associated guide slot 150. In other words, each guide tab 119 is inserted into its matching guide slot 150. Thus, there are two pairs 119, 150 of tabs and slots. These two pairs 119, 150 together form a device for guiding the press rod 130 into the guide cavity 115. It should be noted that each guide tab 119 is integrally formed with the casing 102 and therefore forms an integral part thereof.

As can be seen in FIG. 5, the two electric conductors 108*a* and the movable bridge 136 are located together in an arc extinguishing chamber 154. The arc extinguishing chamber 154 is surrounded by an electrical insulation enclosure that forms part of the casing. FIGS. 5 and 8 show two partitions 156 of the first part 102*a* of the casing 102. These partitions 156 form a section of the electrical insulation enclosure.

With reference to FIG. 6, it can be seen that a lower section of the first part 102*a* of the casing 102 comprises a central receptacle 121. This receptacle 121 is used to accommodate an activation head of another component that is connected to the lower face 114 of the casing 102. The activation head receptacle 121 in this case is in the form of a rectangular enclosure. The walls of the enclosure 121 are produced in the first part 102*a* of the casing 102. FIG. 6 shows that the guide tabs 119 extend into the enclosure 131. When an activation head is inserted into the receptacle 121, this receptacle is surrounded on all sides by the walls of the receptacle 121. The receptacle 121 therefore defines an electrical insulation cage that electrically insulates the inserted activation head from the arc extinguishing chamber 154. This insulation cage comprises a protector 123. In the illustrated example, see FIG. 6, the protector 123 is produced in the form of a guard plate. This guard plate 123 hides a lower part of the guide cavity 115. The guard plate 123 projects relative to the main body of the first part 102*a* of the casing 102. By virtue of the guard plate 123, a technician avoids the risk of being electrocuted if they inadvertently insert one of their fingers, or a metal part connected to their fingers, into the receptacle 121.

The operation of the electric contact block 100 of FIGS. 4 to 9 will now be described.

Pressing the activation head 140 moves the press rod 130 from a rest position to an activation position (it should be noted that the figures only show the rest position). When it moves towards its activation position, the press rod presses into the casing 102. In order to perform this translation movement of the press rod 130, the resistance of the two return springs 110 needs to be overcome. The press rod 130, and consequently the movable contact unit 104, slides towards the lower face 114 of the casing 102, until a mechanical and electric contact is established between the contact points 137 of the movable bridge 136 and the contact points 113 of the electric conductors 108*a*. Once the press rod 130 is released, said press rod returns to its rest position by virtue of the action of the return springs 110. Thus, the movable bridge 136, which moves together with the press rod 130, breaks or establishes an electric contact between the two electric terminals 108.

By virtue of the guide device according to the present disclosure, namely the two tab/slot pairs 119, 150, the reciprocating movement of the press rod 130 within the casing 102 is well controlled. In particular, it is not possible for the movable contact unit 104 to remain or be stuck in the casing during the translation movement thereof, particularly when the activation head 140 is rotationally stressed by a rotary knob. The guide device with matching tab and slot minimizes the play and the degrees of freedom of the press rod 130, which is therefore forced to exactly follow the desired translation movement. This allows the height of the press rod 130, and therefore the height of the electric contact block 100, to be reduced.

As can be seen in FIG. 5, when travelling between the rest position and the activation position, the movable bridge 136 is guided by the partitions 156, which thus form guide walls for the movement of the movable bridge 136.

FIGS. 10 and 11 show an example of a control unit 200 comprising a stack of four electric contact blocks 100 of the type illustrated in FIGS. 4 to 9. The control unit 200 is made up of a push-button 202, a base plate 204, and a stack 206 of four electric contact blocks 100. FIG. 10 is a side view of the control unit 200. FIG. 11 is a longitudinal section view. The four electric contact blocks 100 are connected together by virtue of their extendable screws 106. More specifically, the two upper contact blocks of the stack 206 are screwed into the lower face of the base plate 204 using their extendable screws 106. For their part, the extendable screw 106 of the two lower contact blocks of the stack 206 is screwed into a thread of an extendable screw 106 of one of the upper contact blocks.

FIG. 11 clearly distinguishes the four press rods 130. The activation heads 140 of the lower press rods are located in the receptacles 121 of the upper contact blocks. Furthermore, the activation heads 140 of the lower press rods 130 touch the bases 142 of the upper press rods.

Pressing the push-button 202 in the vertical direction (see the arrow V in FIG. 11) thus presses the two upper press rods into their contact blocks against the return springs 110. During this operation, the upper press rods move from their rest position to their activation position and transfer a translation force to the press rods 130 of the lower contact blocks of the stack 206. The press rods of the lower contact blocks are also moved towards their activation position. Thus, by pressing the push-button 202, all four electric contact blocks 100 are activated at the same time.

FIGS. 12 to 16 show an embodiment 300 of a stackable signalling block according to the present disclosure. It involves an indicator block capable of transmitting a light signal to indicate an operating state of a control unit in which it is included.

Figure 16:
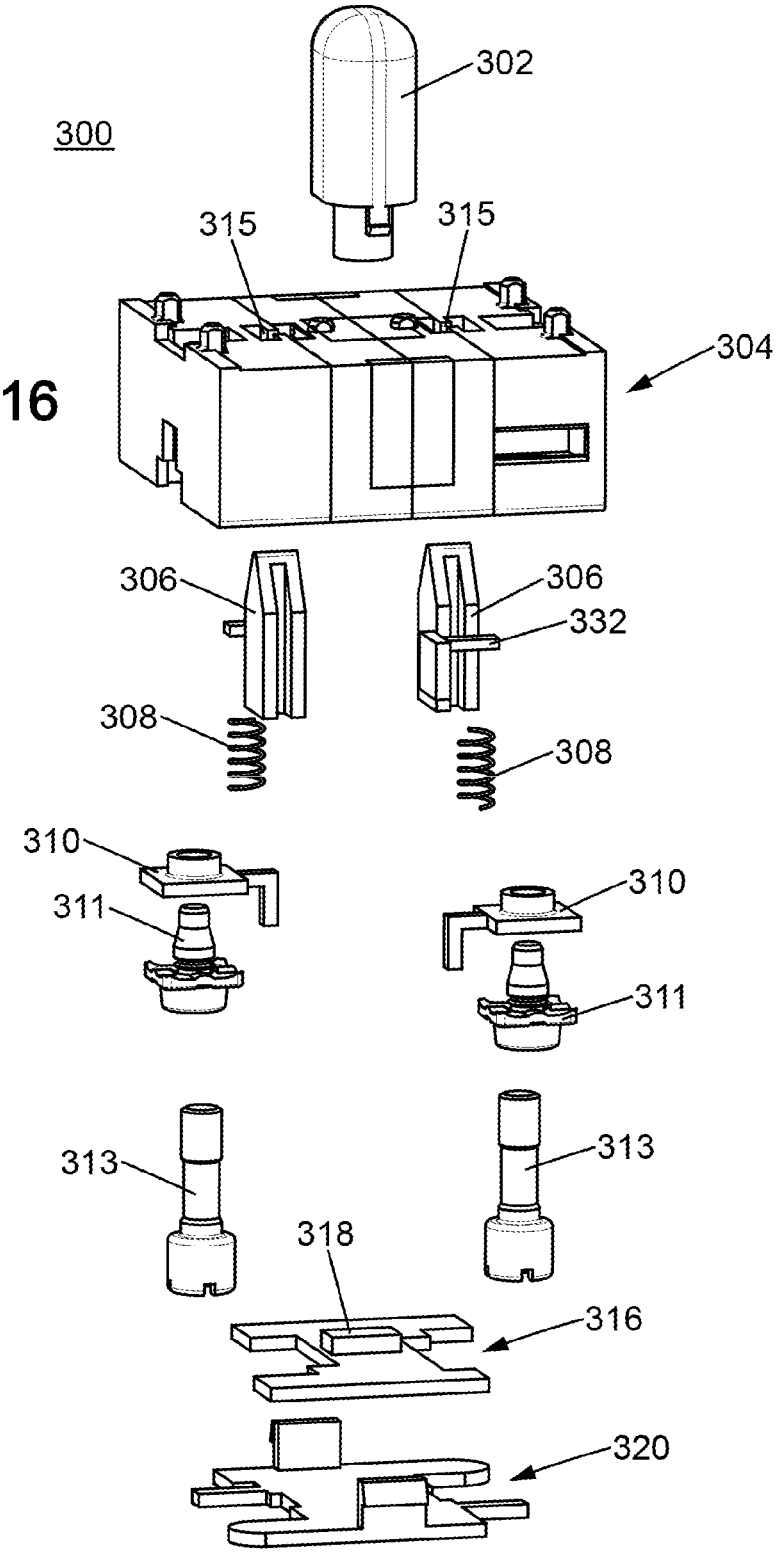
FIG. 16 is an exploded view of the signalling block of FIG. 12.

With reference to FIG. 16, the indicator block 300 comprises a light guide 302, a casing 304, two press rods 306 with their return springs 308, two electric terminals 310 with their clamping screw 311, two fixing screws 313, a printed circuit 316 supporting a light emitting diode 318, and a cover 320.

Figure 15:
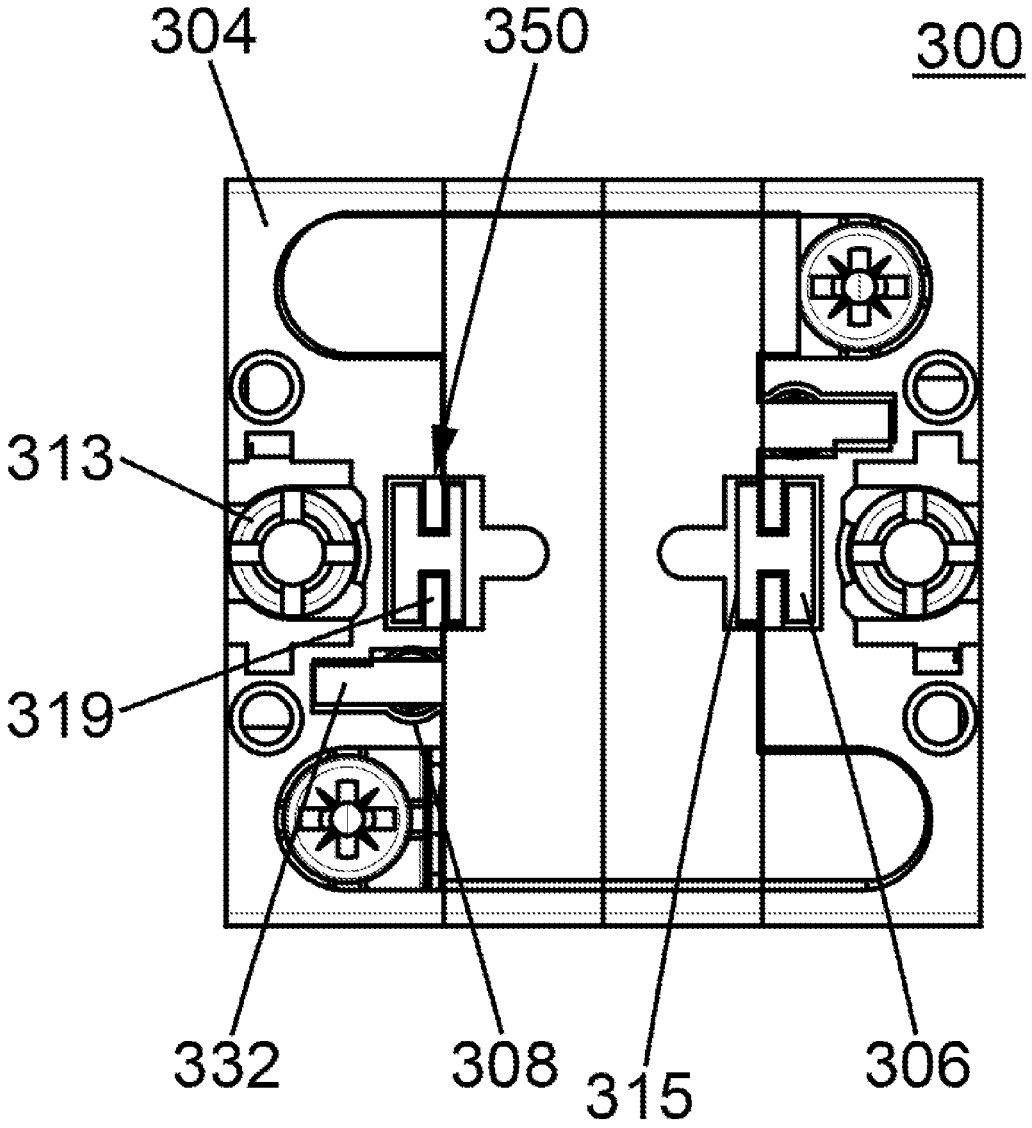
FIG. 15 is a bottom view along the arrow XV of the signalling block of FIGS. 12 and 13, with some elements being omitted.

The casing 304 has upper 312 and lower 314 faces for connecting the indicator block 300 to other components, such as the electric contact blocks 100 of FIGS. 4 to 9, for example. The two press rods 306 of the indicator block 300 each have an activation head 340, which is the same shape as the activation head 140 of the electric contact block 100 of FIGS. 4 to 9. The activation heads 340 therefore are also in the form of a wedge and are traversed by two opposite guide slots 350. The device for guiding the press rods 306 is similar to that of the electric contact blocks 100. Therefore, there are also two guide tabs 319 for each press rod 306. As can be seen in FIG. 15, each press rod 306 also has a substantially H-shaped transverse section.

Each press rod 306 has a stop element 332 acting as a support for its return spring 308. It should be noted that the longitudinal axis of each return spring 308 is offset relative to the longitudinal axis of its corresponding press rod 306. Furthermore, each return spring 308 is arranged laterally relative to its press rod 306.

The casing 304 is provided with two guide cavities 315, one for each press rod 306.

Figure 14:
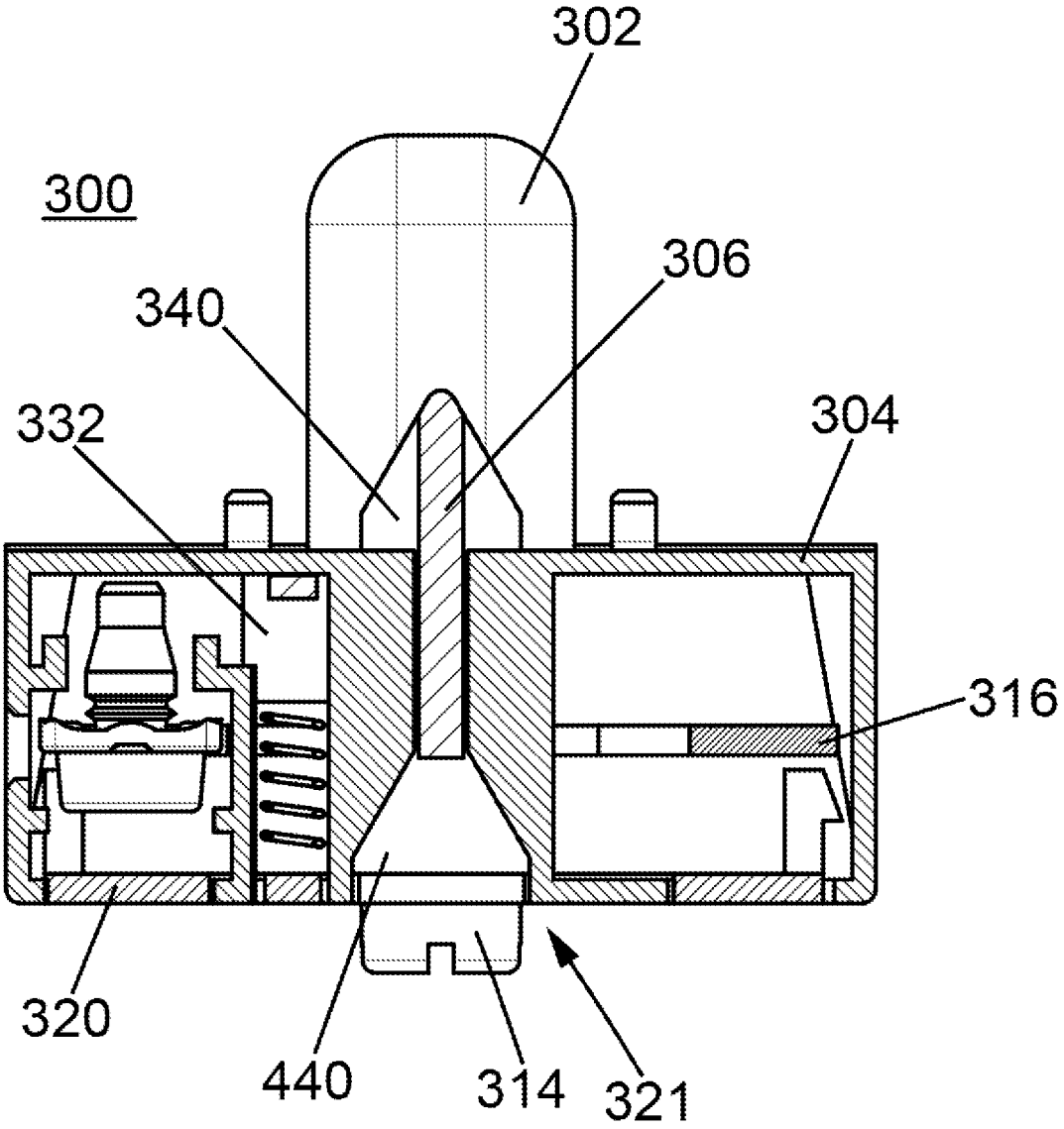
FIG. 14 is a transverse section view along the arrows XIV of the signalling block of FIGS. 12 and 13.

FIG. 14 illustrates how an activation head 440 of a press rod of another block is accommodated in the indicator block 300 during a stacking operation. It clearly shows how the activation head 440 is inserted into the receptacle 321 of the casing 304 of the indicator block 300. The tip of the activation head 440 touches the base of the press rod 306 of the indicator block 300.

Figure 17:
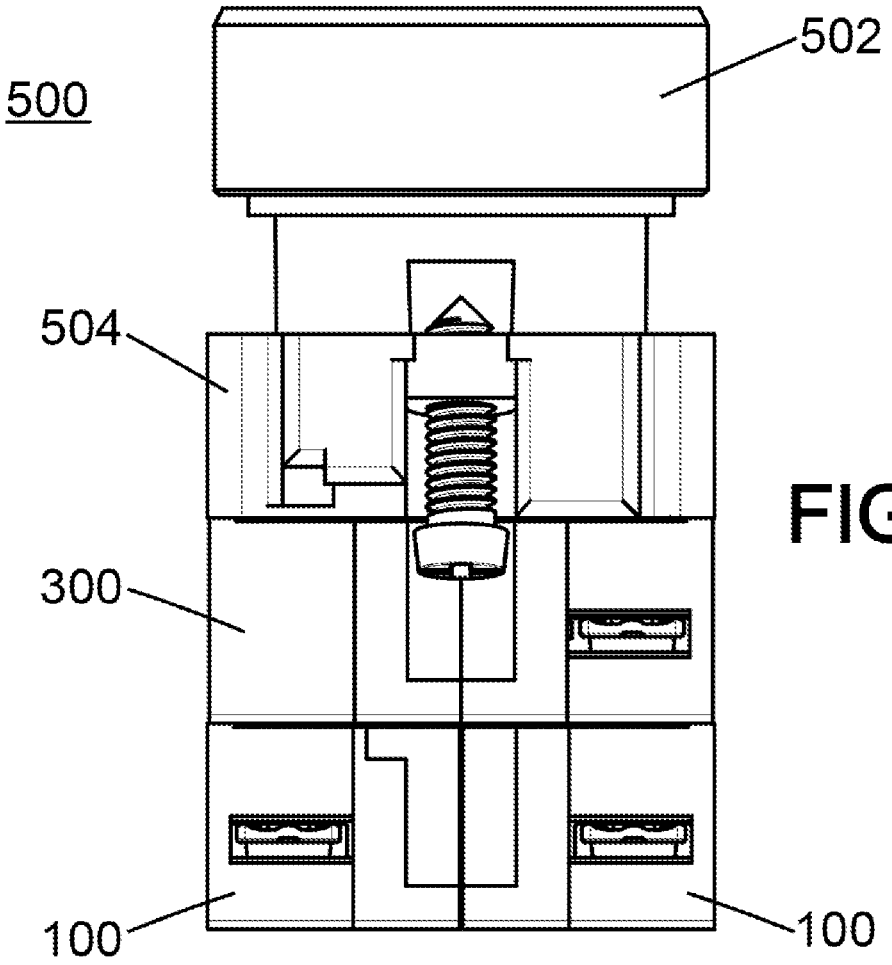
FIG. 17 is a side view of a button control unit comprising a signalling block according to FIG. 12 and two stacked contact blocks according to FIG. 4.
Figure 18:
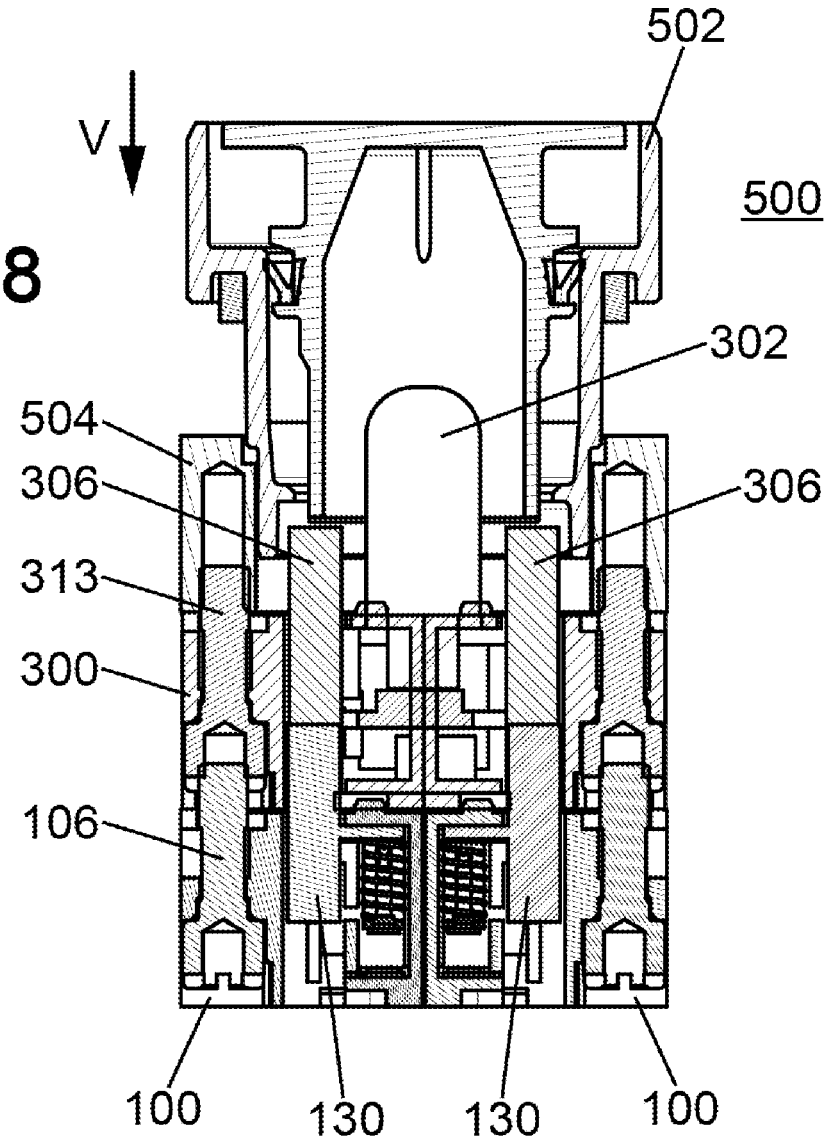
FIG. 18 is a section view of the control unit of FIG. 17.

FIGS. 17 and 18 show an embodiment 500 of a control unit incorporating two electric contact blocks 100 and an indicator block 300. As for the control unit 200 of FIGS. 10 and 11, the control unit 500 comprises a push-button 502 and a base plate 504. The indicator block 300 is screwed onto the base plate 504 by means of its extendable screws 313. The two electric contact blocks 100 are screwed onto the lower face 314 of the indicator block 300 using their extendable screws 106.

Pressing the push-button 502 in the vertical direction (see the arrow V in FIG. 18) presses the two press rods 306 inside the indicator block 300. The press rods 306 transfer this translation force to the press rod 130 of the contact blocks 100.

It is thus understood that, by virtue of its press rods 306, the indicator block 300 can be stacked with contact blocks 100.

The control unit 500 not only allows electric contacts to be established by pressing on the push-button 502, but is also capable of displaying its state to a user by virtue of the LED of the indicator block 300, all in a very compact and integrated manner.

The electric contact and signalling blocks according to the present disclosure particularly have the following technical advantages:

- low height, which allows a large number of blocks to be stacked in a restricted space;
- high strength for the stacks formed on the basis of the blocks by virtue of the fixings screws;
- compatibility with push-buttons and with rotary knobs by virtue of the wedge shape of the activation heads;
- electrical insulation in accordance with standards despite their compactness and their low height.

The present disclosure is not limited to the embodiments that are described above solely by way of an example, but it encapsulates all the variants that can be contemplated by a person skilled in the art within the scope of the protection that is sought, as defined by the following claims.

The invention claimed is:

1. A stackable electric contact or signalling block comprising a casing that defines a volume of the block, the casing having upper and lower faces for connecting the block to another component, the casing accommodating the following elements:

- a screw for fixing the block to another component; and
- a press rod capable of moving from a rest position to an activation position for transferring a translation force to a component attached to the lower face of the casing, the press rod comprising an activation head in a form of a wedge capable of translationally engaging with a push-button or of rotationally engaging with a rotary knob;

the casing comprising a guide cavity for guiding the press rod between the rest and activation positions of the press rod, in which guide cavity the press rod is accommodated, characterized by a device for guiding the press rod into the guide cavity comprising at least one guide tab accommodated in a matching guide slot passing through the activation head.

2. The block according to claim 1, wherein the press rod comprises a base supporting the activation head, and wherein the guide slot also passes through the base.

3. The block according to claim 1, wherein the guide device comprises two guide tabs, each of which is accommodated in a respective matching guide slot passing through the activation head.

4. The block according to claim 1, wherein each guide tab forms part of the casing.

5. The block according to claim 1, wherein the press rod has a substantially H-shaped transverse section.

6. The block according to claim 1, wherein the press rod has an external face, an internal face and two lateral faces, and wherein each guide slot is produced in one of the lateral faces.

7. The block according to claim 6, wherein the casing also accommodates at least one return spring for the press rod, with the return spring being located next to one of the lateral faces of the press rod.

8. The block according to claim 7, wherein the casing accommodates two separate return springs for the press rod, with one of the two return springs being located next to one of the two lateral faces of the press rod and the other one of the return springs being located next to the other one of the two lateral faces of the press rod.

9. The block according to claim 1, the block being an electric contact block, wherein the press rod supports a movable electric contact bridge that moves together with the press rod.

10. The block according to claim 9, wherein the movable bridge has a substantially U-shape.

11. The block according to claim 9, wherein the travel of the movable bridge is guided by guide walls of the casing.

12. The block according to claim 9, wherein:

the casing also accommodates two electric terminals, the movable bridge being adapted, by movement thereof, to break or establish an electric contact between the two electric terminals;

the two electric terminals and the movable bridge are located together in an arc extinguishing chamber; and the arc extinguishing chamber is surrounded by an electrical insulation enclosure that forms part of the casing.

* * * * *